United States Patent [19]

Porter

[11] 4,125,131

[45] Nov. 14, 1978

[54] FIXED DRIVING CONNECTION BETWEEN A GUIDE ROLLER AND DELIVERY ROLLER OF A LOOM

[75] Inventor: Allan W. H. Porter, Lustmuhle, Switzerland

[73] Assignee: Adolph Saurer, Arbon, Switzerland

[21] Appl. No.: 831,607

[22] Filed: Sep. 8, 1977

[30] Foreign Application Priority Data

Sep. 21, 1977 [CH] Switzerland ..... 11947/77

[51] Int. Cl.[2] ..... D03D 49/06; D03D 42/20; D03D 49/04

[52] U.S. Cl. ..... 139/99; 139/100; 139/308

[58] Field of Search ..... 139/99, 97, 100, 109, 139/110, 304, 307, 308, 310, 311

[56] References Cited

U.S. PATENT DOCUMENTS

| | | | |
|---|---|---|---|
| 3,308,854 | 3/1967 | Pfarrwaller | 139/99 |
| 3,561,497 | 2/1971 | Vandoolaeghe | 139/99 |
| 3,645,300 | 2/1972 | Geven et al. | 139/308 |
| 3,878,872 | 4/1975 | Hintsch | 139/99 |
| 3,901,283 | 8/1975 | Filter | 139/99 |

FOREIGN PATENT DOCUMENTS

| | | | |
|---|---|---|---|
| 580,746 | 9/1924 | France | 139/99 |
| 50-37,784 | 12/1975 | Japan | 139/304 |
| 393,386 | 6/1933 | United Kingdom | 139/99 |

*Primary Examiner*—James Kee Chi
*Attorney, Agent, or Firm*—Bailey, Dority & Flint

[57] ABSTRACT

A loom including a drive device for weaving fabric from warp yarn extending from a source over a back rest provided adjacent one end of the loom and after being woven into fabric being fed over a breast beam positioned adjacent the other end of the loom. A driven roll over which the warp is guided without slippage is disposed in front of the back rest and at least one driven delivery roller over which the woven goods is guided without slippage is disposed after the breast beam. The guide roller and the delivery roller are driven in synchronism and there is a driving connection therebetween, as well as with the main drive shaft of the loom.

7 Claims, 1 Drawing Figure

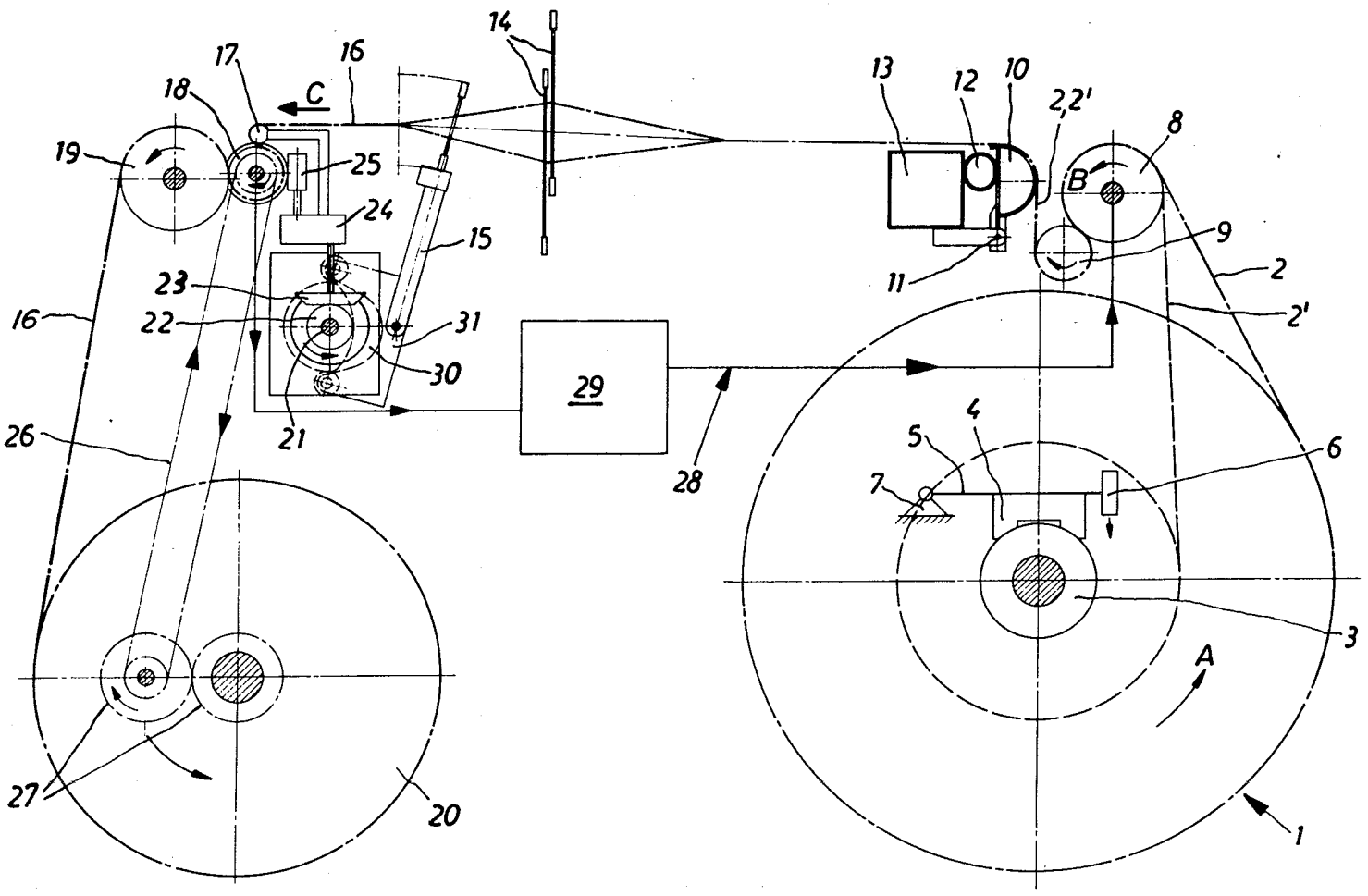
1
2
2'
3
4
5
6
7
8
9
10
11
12
13
14
15
16
17
18
19
20
21
22
23
24
25
26
27
28
29
30
31
A
B
C

FIXED DRIVING CONNECTION BETWEEN A GUIDE ROLLER AND DELIVERY ROLLER OF A LOOM

BACKGROUND OF THE INVENTION

The present invention relates to a loom, and more particularly to a loom having a back rest, a breast beam and a driving mechanism therefor for driving the warp yarn and fabric during the weaving operation.

In conventional looms, the winding of the woven goods on the cloth beam and the removal of warp from the warp beam are controlled independently of one another by separate devices. The winding of the woven goods on the cloth beam is controlled by a regulator with which the density of the weft can be selected. A letoff serves to maintain as constant as tension as possible in the warp running off of the warp beam. Essentially these devices have to perform the task of keeping the average peripheral speed of the warp and cloth beam constant, that is to say, to adapt the average speed of rotation of these beams to the diameter of the yarn and fabric wound thereon which alters as the weaving process progresses.

As is known, this can be achieved, for example by regulating the rate of action of the cloth beam drive, or by utilizing a braking force or by regulating the magnitude of the braking force acting on the warp beam depending on the diameter of the wound goods, or by sensing the warp remaining on the warp beam. Such devices are generally expensive in construction. In addition, this mode of regulation requires powerful drive and bearing members for the cloth beam and warp beam in order that the considerable tensions of the warp and woven goods which occur can be taken up satisfactorily.

SUMMARY OF THE INVENTION

According to the invention this problem is solved in that as seen in the direction of travel of the warp or the woven goods, a driven guide roller, over which the warp is guided without slippage, is disposed in front of the back rest, and at least one driven delivery roller, over which the woven goods are guided without slippage is disposed after the breast beam. The guide roller and the delivery roller are in driving connection with one another and with the main drive shaft of the loom.

Accordingly, it is an object of the present invention to provide a loom wherein the control of the withdrawal of the warp and the winding of woven goods is effected in a simple and reliable manner.

Another important object of the present invention is to provide a loom which minimizes the forces caused by the tension of the warp and the woven goods during the weaving operation so as to minimize the loading of the bearings and drive members associated with the warp beam and cloth beam.

These and other objects and advantages of the invention will become apparent upon reference to the following specification, attendant claims, and drawing.

BRIEF DESCRIPTION OF THE DRAWING

The FIGURE illustrates in schematic form a loom constructed in accordance with the present invention.

DESCRIPTION OF A PREFERRED EMBODIMENT

Referring to the drawing, reference character 1 designates a warp beam on which the warp is wound which is illustrated at two different moments in the weaving process and is designated by 2 and 2', respectively. The warp beam 1, which rotates in the direction of the arrow A, comprises a brake drum 3 on which there acts a brake shoe 4 which is secured to a lever 5 which carries a weight 6 at one end and is mounted for rotation at the other end by means of a bearing 7.

The warp 2, 2' running off the warp beam 1 is guided without slippage over a first guide roller 8, driven in the direction of the arrow B, and over a second guide roller 9, rotating in the opposite direction. In order to obtain guiding without slip, the warp 2, 2' bears against these guide rollers 8, 9 over more than half the periphery. The warp 2, 2' leaving the second guide roller 9 is guided over a back rest 10 which is mounted in the machine frame for rocking about the axis 11 and is supported on a stationary support 13 through a spring bellows 12.

The formation of the shed by means of the heddles 14, the insertion of the weft and the beating up of the inserted weft by movement of the slay 15 are effected in a known manner. The woven goods 16 travel in the direction of the arrow C over a breast beam 17 from which the woven goods 16 run without slippage over a first driven delivery roller 18 and a second delivery roller 19, rotating in the opposite direction, and is wound on a cloth beam 20. The woven goods 16 bear against the delivery rollers 18, 19 over half or more of the diameter, as a result of which slip-free guiding of the woven goods is obtained.

The first delivery roller 18 is driven by the main shaft 21 of the machine which is driven in a suitable manner, not illustrated. For this purpose, a first bevel-gear wheel 22, which is in mesh with a second bevel-gear wheel 23, is mounted on the main shaft 21. The bevel-gear wheel 23 drives a gear 24 with a constant gear ratio which can be selected, which gear in turn rotates a worm wheel 25 which turns the delivery roller 18 in the direction of the arrow shown. In this manner, the delivery roller 18 is in permanent and fixed rotatry connection with the main shaft 21 of the machine. The delivery roller 18 is further in loose rotary connection with the cloth beam 20 through a belt or a link chain 26 and a slipping clutch 27. The slipping clutch 27 may, for example, be a friction or fluid clutch of known construction.

There is also a permanent and fixed rotary connection 28 between the delivery roller 18 and the first guide roller 8. This rotary connection 28 is only shown diagrammatically and may be constructed in any suitable manner. Preferably a transmission 29 with a variable transmission ratio, for example a gear, toothed rims and the like is connected into the rotary connection. The rotary connection 28 can be effected, for example, by a rotary selector system, link chains and the like.

The drive of the slay 15 is effected, for example, by means of a cam 30 secured to the main shaft 21 of the machine and a forked lever 31 mounted on the slay 15. Since there is a permanent and fixed rotary connection between the delivery roller 18, the guide roller 8 and the main shaft 21 of the machine, the expensive control-switch mechanism which is needed in conventional looms for the regulators, for the drive of the cloth delivery roller and of the cloth beam can be omitted. In the loom described, the withdrawal of the warp 2, 2' or of the woven goods 16 is effected at a constant uniform speed.

The tension of the warp 2, 2' is largely independent of the braking force acting on the warp beam 1 and can theoretically be reduced to zero. The tension of the warp 2, 2' and of the woven goods 16 is determined only by the spring force of the bellows 12, which is selected very low. This spring force of the bellows 12 merely serves to permit the formation of the shed without appreciable increase in the tension of the warp 2, 2'.

The braking force acting on the warp beam 1 can now be selected very low and only needs to be great enough to prevent sagging and associated entanglement of the warp threads. The warp beam 1 could even be omitted in which case the warp is withdrawn from a supply, for example a frame.

The force for driving the cloth beam 20 is likewise without influence on the weaving process. This drive force is produced by the main shaft 21 of the machine via the slipping clutch 27 without adaptation to the amount of woven goods 16 wound up.

The release of the warp 2, 2' and the required manner of weaving in the weft threads through the warp threads is determined by the suitable selection of the transmission ratio of the transmission 29. The transmission ratio is selected so that the mean warp release speed or the peripheral speed of the first guide roller 8 is at least equal to or greater than the peripheral speed of the first delivery roller 18.

The density of the weft is determined by suitable selection of the transmission ratio of the gear 24 between the main drive shaft 21 and the first delivery roller 18.

The freedom from slip of the warp threads 2, 2' on the guide rollers 8, 9 and of the woven goods 16 on the delivery rollers 18, 19 is caused by the warp and the woven goods respectively wrapping as far as possible round these rollers.

Such a great wrap-round is achieved, as described, by the fact that the warp 2, 2' and the woven goods 16 bear against the two guide rollers 8, 9 rotating in opposite directions and against the delivery rollers 18, 19, respectively over at least half the periphery.

It is also possible, however, to ensure this freedom from slip in other ways. Thus the rollers could be provided with a suitable friction covering, for example a rubber covering.

While a preferred embodiment of the invention has been described using specific terms, such description is for illustrative purposes only, and it is to be understood that changes and variations may be made without departing from the spirit or scope of the following claims.

What is claimed is:

1. A loom including a drive device for weaving fabric from warp yarns extending from a source over a back-rest provided adjacent one end of said loom and after being woven into fabric being fed over a breast beam positioned adjacent the other end of said loom, said improvement comprising:

at least one driven guide roller disposed in front of said back rest relative to the direction of flow of said warp yarn;

means for guiding said warp yarns over said driven guide roller in a non-slip manner;

at least one driven delivery roller disposed after the breast beam relative to the direction of flow of said warp yarn;

means for guiding said woven fabric over said driven delivery roller in a non-slip manner;

said guide roller and said delivery roller being in a fixed driving connection with one another and with said drive device.

2. The loom as set forth in claim 1 wherein said drive device is a driven main shaft of said loom; and means for driving said delivery roller and said guide roller from said main drive shaft.

3. The loom as set forth in claim 2 wherein said means for driving said delivery roller and guide roller includes a driving connection between said delivery roller and said guide roller; and a transmission means interposed in said driving connection between said delivery roller and said guide roller for selectively chosing the constant drive ratio between said delivery roller and said guide roller.

4. The loom as set forth in claim 3 further comprising said transmission means having a drive ratio so that the peripheral speed of said guide roller is equal to or greater than the peripheral speed of said delivery roller.

5. The loom as set forth in claim 1 further comprising:

a cloth beam for taking up said fabric after said fabric passes over said breast beam;

a driving mechanism connected between said drive device and said cloth beam for driving said cloth beam; and a slip clutch forming part of said driving mechanism.

6. The loom as set forth in claim 1 further comprising:

a cloth beam for taking up said fabric after said fabric passes over said breast beam;

drive means driving said cloth beam off of said delivery roller; and a slipping clutch forming part of said drive means disposed between said cloth beam and said delivery roller.

7. The loom as set forth in claim 2 wherein a transmission means is interposed in said driving connection between said drive device and said delivery roller for selectively chosing the constant drive ratio between said drive device and said delivery roller.

* * * * *